United States Patent [19]

Schwer et al.

[11] Patent Number: 4,823,329

[45] Date of Patent: Apr. 18, 1989

[54] ELECTRIC TIMER WITH PROGRAM CARRIER SWITCHABLE FROM A SHORT TERM TO A LONG TERM PROGRAM

[75] Inventors: Lukas Schwer; Manfred Karger, both of Haigerloch, Fed. Rep. of Germany

[73] Assignee: Theben-Werk Feitautomatik GmbH, Fed. Rep. of Germany

[21] Appl. No.: 169,410

[22] Filed: Mar. 17, 1988

[30] Foreign Application Priority Data

Mar. 17, 1987 [DE] Fed. Rep. of Germany ..... 3708611

[51] Int. Cl.[4] ..... G04F 8/00; H01H 43/00

[52] U.S. Cl. ..... 368/107; 200/38 R; 200/38 DA

[58] Field of Search ..... 368/107–113; 200/38 R, 38 B, 38 D, 38 DA

[56] References Cited

U.S. PATENT DOCUMENTS 3,864,539 2/1975 Hauser ..... 300/38 DA
4,297,546 10/1981 Koch ..... 200/38 DA
4,410,774 10/1983 Houpt et al. ..... 200/38 E
4,558,192 12/1985 Thomb ..... 200/38 D

*Primary Examiner*—Vit W. Miska
*Attorney, Agent, or Firm*—McGrew & Tuttle

[57] ABSTRACT

In the electric timer having an analog time display and a disk-or ring-shaped program carrier programmable by means of slide contacts, the program carrier is settable selectively by means of a switching device to different synchronous speeds of rotation, namely one revolution per week or one revolution per day. To this end two drive rings concentric with the axis of rotation of the program carrier are provided, of which one revolves at a speed of one revolution per day and the other at one revolution per week. The program carrier can be coupled selectively with one of the two drive rings by means of a coupling member adjustable to radii of different size on the same radius vector. While the drive ring revolving at the slow speed can be coupled with the program carrier in seven different angular positions, for the drive ring which revolves once a day only a single angular position exists in which it can be coupled with the program carrier.

13 Claims, 2 Drawing Sheets

Fig. 1
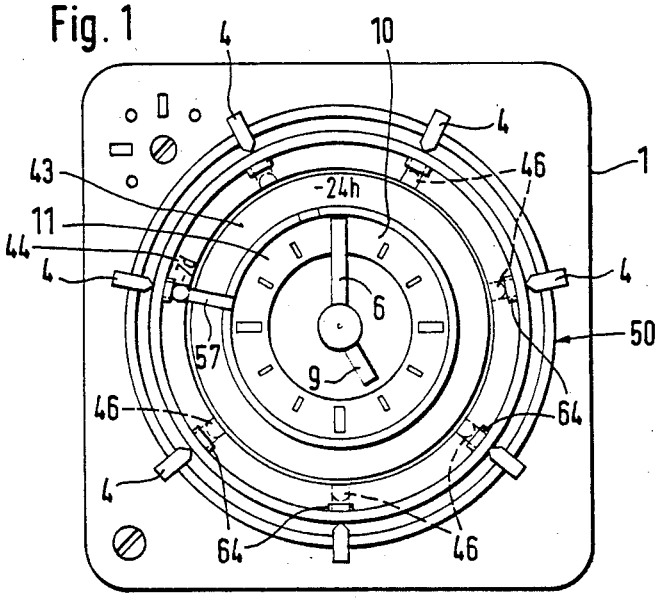
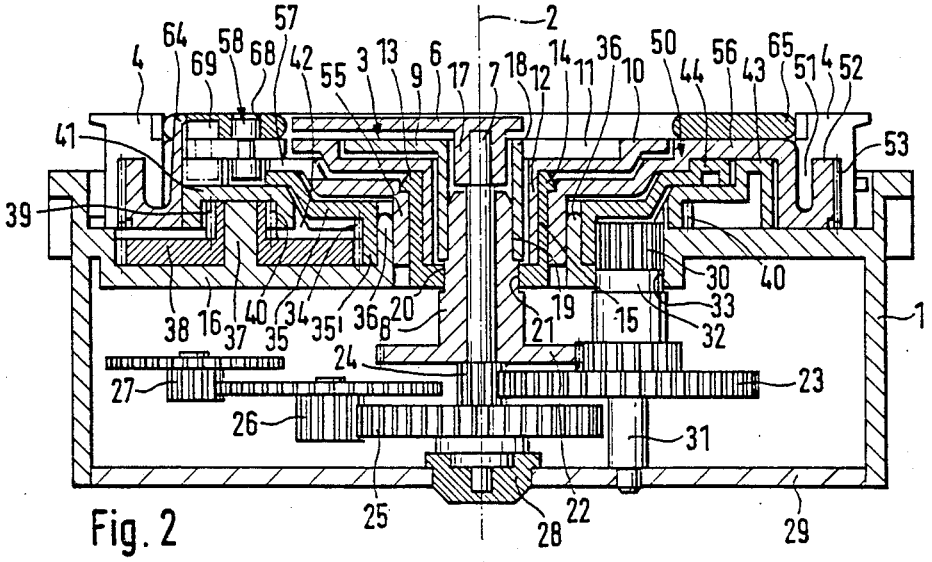
Fig. 2

Fig. 3
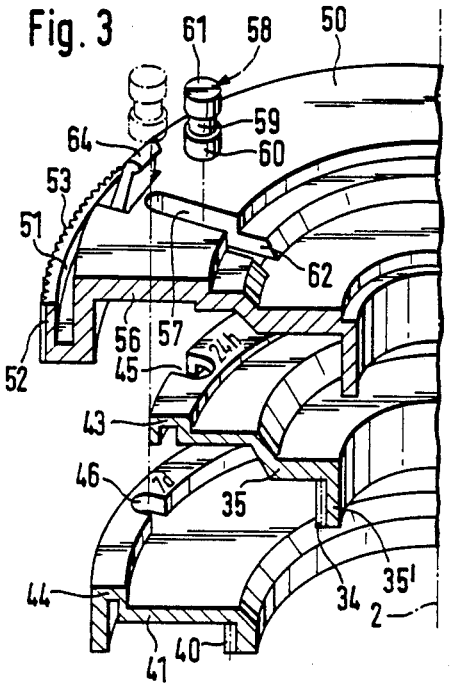
Fig. 6
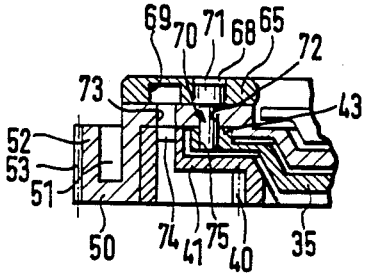
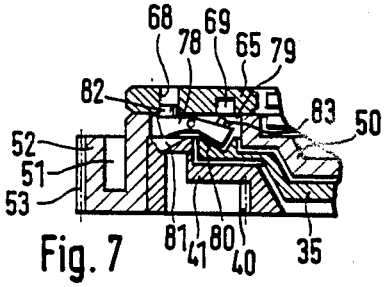
Fig. 7
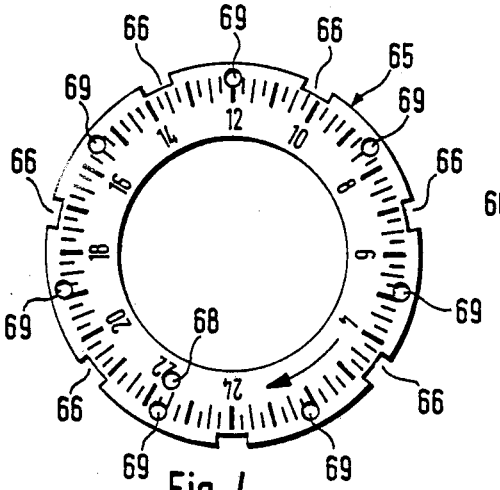
Fig. 4
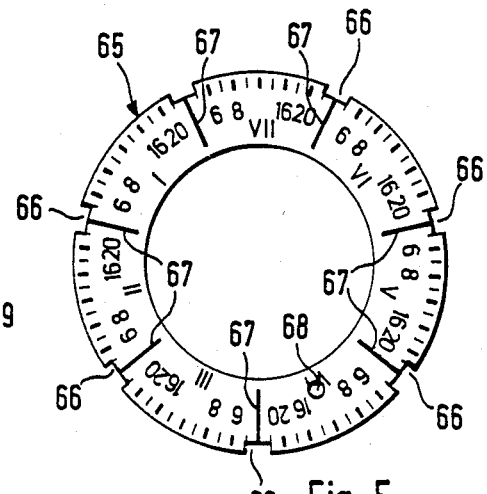
Fig. 5

ELECTRIC TIMER WITH PROGRAM CARRIER SWITCHABLE FROM A SHORT TERM TO A LONG TERM PROGRAM

FIELD AND BACKGROUND OF THE INVENTION

The invention relates to an electric timer with an analog time display and with a disk-or ring-shaped program carrier synchronously driven by a time-controlled clockwork and provided with slide contracts, which program carrier can be switched by means of a switching device from a speed of rotation of e.g. one revolution in 24 hours, corresponding to a short-term program, to a speed of rotation of e.g. one revolution in seven days, corresponding to a long-term program, and vice versa, and the slide contacts of which actuate a contact system, a scale ring corresponding to the set short-or long-term program being able to be selectively applied on the program carrier.

Electric timers of this kind, wherein for both programs, namely for a long-term or weekly program and for a short-term or daily program, one and the same program carrier is provided, are known.

In German Pat. No. 28 35 518 such a timer is disclosed in which the program carrier is firmly connected with the clockwork and is assigned to a single contact system. It can be set by a switchgear, e.g. to one revolution per week or to one revolution per day. The switchgear then consists of two gears of different rotational speed non-rotationally connected with the program carrier and arranged axially offset to each other and concentric with each other as well as concentric with the axis of the program carrier, as well as of two interconnected gears which are fixed on a drive shaft but are axially displaceable and which can be brought in engagement selectively with one or the other gear of the program carrier by axial displacement. Because the switching of the drive speed of the program carrier then occurs through axial displacement of two interconnected gears and it must be assured that in an intermediate position both of these displaceable gears must be simultaneously out of engagement with the two gears of the program carrier, there results in this known timer necessarily a relatively great axial overall height.

In this known timer it has also been known practice to reversibly place on the scale support a scale ring imprinted with scales on both sides, which indicates in each instance in time-correct manner the selected short-term or long-term program and with which it is possible also to set the scale support to the correct time of day or of the week. To avoid faulty switching that could result in a wrong clock time setting on the program carrier, this known timer has the switchgear provided with a barrier which permits switching only in certain time settings of the program carrier or respectively of the analog time display. This entails on the one hand additional cost of components and, on the other hand, additional complication in operating the timer.

Known from German Pat. No. 31 48 704 is a multirange switching device, in particular for timed switching devices, where a revolving switching or indexing disk is permanently connected with the timed switching device. To drive the disk at different speeds, two drive shafts are provided which by a coupling device can be selectively engaged with the disk. The coupling disk is disposed coaxial with the disk. To change the speed of the disk, the coupling device is reversible or displaceable axially. Upon change of the disk speed, the time scale of the short-term or long-term program arranged on the side opposite the engaged coupling device is visible. The scale support is then at the same time the coupling means. With this timer one and the same program carrier can indeed be used for both programs running at different speeds. But because of the necessity of reversing either the scale support as coupling means or the entire program carrier with the scale support and because of the action change connected therewith, there results not only a complicated and difficult handling of the switching means, but also, because of the non-indexing graduations of the interengaging coupling parts there occur in the one program errors and in the other time errors which cannot readily be avoided or eliminated. Besides, in this timer the central arrangement of a dial train with analog display is not possible.

SUMMARY AND OBJECT OF THE INVENTION

It is the object of the invention to improve an electric timer of the initially mentioned kind by a special design of the switching device in such a way that a very flat construction in an axial direction becomes possible and the switching from one program, i.e. the weekly program, to the daily program or vice versa, can be carried out in a very simple manner and without causing an action change that would lead to time errors.

According to the invention, this problem is solved in that, by means of a coupling member adjustable to radii of different size on the same radius vector, the program carrier can selectively be coupled with one of two drive rings disposed concentric with the axis of rotation of the program carrier, one drive ring being driven at the speed corresponding to the short-term program and the other drive ring at the speed corresponding to the long-term program.

By this switching device, the main component of which is the coupling member selectively to be brought in engagement with one of the two drive rings, it is ensured that, when switching from the long-term to the short-term program and vice versa, gearing action changes do not take place, and that accordingly time errors at the program carrier cannot occur. In addition, the switching can be carried out very simply from the front side of the program carrier without having to remove the latter itself.

For the individual design of the coupling member there are several possibilities, the most advantageous of which are highlighted in the following description.

The design of the coupling member according to one embodiment of the invention, including coupling member formed of a downwardly protruding coupling pin which is displaceable in the radial slot of the program carrier and is fixable in two different radial positions, two drive rings include coupling slots radially open toward each other, for the coupling seating of the guide pin has the further advantage, besides easy manufacture and operation, that the coupling member is captively connected with the program carrier and at the same time indicates by its respective position which of the two programs is just then turned on. The coupling member designed according to another embodiment of the invention includes a plug-in or threaded pin which is selectively insertable into one of two plug-in or threaded bores lying on the same radius vector, in such a way that it protrudes couplingly into a coupling recess of one or the other drive ring and has the advantage that it can be retrofitted on the program carrier and does not require pre-assembly. The design of the coupling member according to another embodiment of the invention includes a rocker pivotably mounted in a radial slot of the program carrier, the rocker is positioned in one of two possible pivoted positions and engages couplingly in a coupling recess one drive ring and in another pivoted position in a coupling recess another drive ring. This embodiment has the advantage that it combines the advantages of the coupling members designed according to the above discussed embodiments.

If the long-term program is an integral multiple of the short-time program, that is, for example, if the long-term program comprises seven days and the short-time program one day, it is of advantage to design the drive ring which is driven at the speed corresponding to the long-term program to include at equal angular distances, as many coupling slots or coupling recesses as correspond to the number that indicates how many times the period of the short-term program is contained in the period of the long-term program. Thereby, in fact, the switching from short-time program to long-time program is simplified inasmuch, as, to reach the switching position in which two coupling slots or coupling recesses of the two drive rings are opposite each other in radial alignment, the drive ring of the long-term program must be rotated at most by less than 1/7 of its circumference. In other words, to reach this switching position, one must rotate the drive ring of the long-term program maximally by an angle which corresponds to the time segment of the short-term period.

In this connection also an embodiment of the invention including a drive ring driven at the speed corresponding to the short-term program having only one coupling slot or one coupling recess, is of importance inasmuch as by it, it is ensured that switching always occurs at the indication of the time of day, that is, that no time errors can result upon switching. In the same respect, also an embodiment of the invention including coupling slots or coupling recesses of the drive ring revolving at the speed of the long-term program and arranged so that at the same time of day the coupling slot or respectively the coupling recess of the drive ring revolving at the speed of the short-term program is aligned radially, is of importance, by which it is further ensured that a scale ring provided with the scale of the long-term program can be arranged on the program carrier angularly offset by a period corresponding to the short-term program.

By a variant of the invention a coupling pin is provided having a guiding neck which as compared with its section protrudes at the bottom of the program carrier and is reduced in its thickness, the possibility exists of providing a simple positive connection between the coupling pin and the program carrier and a simple possibility to establish a time-correct angular position between the program carrier and the coupling pin.

An additional variant of the invention includes a head portion of the coupling pin having a greater thickness than the guiding neck which is adapted to the width of the radial slot which offers the possibility to connect the coupling pin positively with the program carrier in a simple manner already during pre-assembly, and moreover the coupling pin is guided better in the radial slot of the program carrier, so that it can be adjusted more easily.

The scale ring designed according to the invention includes a flat scale ring which bears on one of its two ring faces a time scale corresponding to the long-term program and on the other ring face a time scale corresponding to the short-term program, the flat scale may be concentrically placed on the program carrier lockingly and attachably which may be used in a simple manner for both programs in that in each instance it is placed on the program carrier in such a way that the time scale associated with the set program is visible from the front. By the design according to claim 12, it can be ensured also in a simple and reliable manner that the scale ring always occupies the time-correct angular position on the program carrier, regardless of which program is set just then.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 1 is a front view of an electric timer according to the invention with the scale ring removed;

FIG. 2 is a sectional view of the timer of FIG. 1;

FIG. 3 is an exploded perspective partial sectional view of the program carrier and of the two drive rings;

FIGS. 4 and 5 are two frontal views of a scale ring;

FIG. 6 a detail from FIG. 2 with a differently designed coupling member; and FIG. 7 again, a detail from FIG. 2 with still another form of the coupling member.

DESCRIPTION OF THE PREFERRED EMBODIMENTS

Referring to the drawings in particular, the invention embodied therein comprises an electric timer with an analog time display having a disk- or ring-shaped program carrier synchronously driven by a time controlled clockwork and provided with slide contacts. The program carrier may be switched by a switching means from a speed of rotation of e.g. one revolution in 24 hours, corresponding to a short-term program, to a speed of rotation e.g. one revolution in 7 days, corresponding to a long-term program and visa versa. The slide contacts of the switching means actuate a contact system. The scale ring corresponding to the set short-term or long-term program being able to be selectively applied on the program carrier. A radially displaceable coupling member 58, 70 and 78 is adjustable to different radial positions. The program carrier 50 may be selectively coupled with one of the two drive rings 35 and 41 disposed concentric with the axis of rotation 2 of the program carrier 50. One drive ring 35 is driven at the speed corresponding to the short-term program and the other drive ring 41 is driven at the speed corresponding to the long-term program.

As can be see in particular from FIG. 1 and 2, the illustrated timer includes a substantially square housing 1 with frontwall 16. Coaxially with an axis 2 lying in the intersection of the diagonals of the square, there are arranged outside of the frontwall 16 of the housing a dial train 3 with analog display and a program carrier 50 programmable by slide contacts 4 to be placed on in accordance with the program. The minute hand 6 sits on a minute staff 7, which is arranged coaxially with axis 2 and on which is rotatably mounted in known manner an hour cannon pinion 8 with an hour hand 9. The dial for this clockwork is formed by a ring disk 20 provided with a cylindrical depression 11 and non-rotationally fixed by means of a hub sleeve 12 in a centering collar 15 of the housing front 16 provided with catches 13 and 14. While the minute hand 6 is secured on the minute staff 7 by means of an integrally formed hub shoulder in force-or form-locking union, the hour hand 9 is fitted, by means of a hollow hub 18 to which it is connected in one piece, on a cylindrical shoulder 19 of reduced diameter of the hour cannon pinion 8 in force-locking union. By means of a second cylindrical shoulder 20, the hour cannon is rotatably mounted in a bore 21 of the housing front 16. Its integrally formed hour wheel 22 is in engagement via an intermediate gear 23 common in such clockworks with a pinion 24 of the minute staff 7 with a ratio of 12:1, which pinion is in turn driven by a minute wheel 25 by a time drive (not shown) via additional gearing parts 26 and 27. The minute staff 7 is rotatably mounted in a journal bearing 28 of the housing backwall 29. The intermediate gear 23 is rigidly connected with a pinion 30 coaxial therewith and is rotatably mounted by means of a shaft end 31 in the housing backwall 29 and by means of a cylindrical shoulder 32 of reduced diameter in a bearing bore 33 of the housing frontwall 16. This pinion 30 is in engagement with the toothed rim 34 of a first drive ring 35 which is rotatably guided at a centering ring 36 of the housing frontwall 16 by means of a cylindrical ring collar 35'. On the side diametrically opposite pinion 30, there is mounted on an integrally molded journal pin 37 of the housing frontwall 16 a gearwheel 38 provided with an integrally molded pinion 39, which gearwheel is in engagement with the toothed rim 34 of the drive disk 35 and whose pinion 39 is in engagement with a toothed rim 40 of a second drive 41 which is guided rotatably and concentric with the first drive ring 35 by a partially interrupted ring collar 42 of the housing frontwall 16. The cross-sectional profiles of the two drive rings 35 and 41 can best be seen in FIG. 3. Both drive rings 35 and 41 have a raised edge 43, 44 of U-shaped profile, the upper planar limiting faces of which are located, as can be seen from FIG. 2, in the same axial plane. While edge 43 of drive ring 35 has only one coupling slot 45 open on the outer side, edge 44 of drive ring 41 has a total of seven inwardly open coupling slots 46, arranged at equal angular distances from each other. While drive ring 35, which is driven by pinion 30 directly, executes one full revolution in 24 hours, the drive ring 41 in engagement with pinion 39 of gear 389 rotates at a speed which corresponds to one revolution in seven days.

To these two drive rings 35 and 41 there is assigned a common, partly annular, partly disk-shaped program carrier 50 which in the vicinity of its outer circumference has an annular groove 51 and on the outside of an annular rib limiting this annular groove a fine serration 53 for the positive seating of the slide contacts 4. These slide contacts 4 can be fastened on the program carrier 50 in accordance with the program in the manner indicated in FIG. 1 and 2, and are intended to actuate a contact system of the timer (not shown in the drawing) at the desired times.

The program carrier 50 is guided concentric to the axis 2 by means of a hub 55 between the centering ring 36 and the centering collar 15 of the housing frontwall 16 and is fixed in axial direction by the catches 13 and 14 of the centering collar 15. For this purpose the catches 13 and 14 are provided, as can be seen from FIG. 2, with blade-like hook profiles which fit into a rabbet type cutout in the program carrier.

Above the two edges 43 and 44 of the drive rings 35 and 41 lies a flat ring section 56 which is provided with an inwardly open radial slot 57. This radial slot 57 extends over the total radial width of the two edges 43 and 44. Displaceable in this radial slot 57 is cylindrical coupling pin 58 having a guiding neck 59 of reduced diameter. The thickness of this guiding neck 59 corresponds to the width of the radial slot 57 insofar as the latter lies in the ring section 56. Due to the lower coupling part 60 of larger diameter and the head portion 61 also of larger diameter, the coupling pin 58 is guided in the radial slot 57 almost immobile in the axial direction. To be able to introduce the coupling pin 58 in radial direction from the inside out into the radial slot 57, the part 62 of the radial slot lying below the ring section 56 is made wider, so that the coupling part 60 can be passed through it. Insertion of the coupling pin 58 into the radial slot 57 is done in pre-assembly before the program carrier 50 itself is placed over the two drive rings.

Coupling part 60 of coupling pin 58 can be inserted selectively either into the coupling slot 45 of drive ring 35 or into one of the coupling slots 46 of drive ring 41, so that the program carrier 50 is driven either by drive ring 35 at a speed of one revolution per day or by drive ring 41 at one revolution in seven days. That the switching from one speed to the other can take place only when slot 45 of ring 35 revolving at the speed corresponding to the short-term or daily program is in radial direction opposite a coupling slot 46 of the drive ring 41 driven at the speed corresponding to the long-term or 7-day program, means that program switching can take place only when the clockwork 3 indicates a very specific time of day, e.g. 12 o'clock noon. By this condition necessarily resulting from the mode of operation of the switching device, it is ensured that no time error can occur through the switching from one drive speed of the program carrier to the other.

In the position of the coupling pin 58 shown in FIG. 2 in solid lines, the program carrier 50 is coupled with the drive ring 35 of the short-term or daily program. Dash-dot lines indicate the position of the coupling pin 58 in which the program carrier 50 is coupled with the drive ring 41 and is then driven at the speed of the long-term program.

For monitoring the respective program run, a scale ring 65 to be placed on the flat ring 56 of the program carrier 50 is provided; it is shown in FIG. 4 and 5 as a separate part in its two frontal views. While FIG. 4 shows the 24-hour scale of the short-term or daily program, FIG. 5 shows the back side with the 7-day scale of the long-term program. The scale ring 65 is provided at its periphery with seven rectangular notches 66, into which catches 64 can snap which are formed on the program carrier 50 integrally but radially resilient, to fix the scale ring 65 on the program carrier 50. It can be seen from FIG. 4 and 5 that while the 7-day scale of the long-term program can readily be correlated with the cutouts 66, in that the respective line mark 67 which corresponds to time 0 o'clock can be aligned with the center of such a cutout 66, such a correlation is not possible with the 24-hour scale of FIG. 4. For this reason, the scale ring 65 is additionally provided with a cylindrical bore 68, the diameter of which is matched to the diameter of the head portion 61 of coupling pin 58, and which lies on a radius which corresponds to the position of the coupling journal 58 when the latter couples the program carrier 50 with the drive ring 35 of the short-term program. When the short-term or daily program is switched on, the scale ring 65 can be placed on the program carrier 50 only so that the head portion 61 of coupling pin 58 is received by bore 68. It is then ensured that also the scale ring 65 indicates the correct time of day corresponding to the display of the clockwork 3 and that the sliding contacts 4 set according to this scale will indeed switch at the selected time of day.

It is only for design reasons that this bore 68 lies in the center between two cutouts 66.

It can be seen that the 24-hour scale of scale ring 65 has $24 \times 4 = 96$ divisions. To each of these divisions a gap of the serration 53 of the program carrier 50 may be correlated. If this is the case, the sliding contacts 4 can be moved by minimum angular distances which correspond to a time difference of fifteen minutes.

When the long-term program is switched on and the coupling pin 58 is in the position entered in dash-dot lines in FIG. 2, scale ring 65 is placed on the program carrier 50 in the position shown in FIG. 5, so that the 7-day scale is visible. The side visible in FIG. 4 then points downward. But because the daily program, i.e. the short-term period of 24 hours, is contained in the 7-day program, i.e. in the long-term period, seven times, seven such bores 69 are disposed at equal angular distances from each other on the side of the scale ring 65 which in this case is down, in such a way that one of them is aligned with bore 68 in radial direction, i.e. lies on the same radius vector as bore 68. For the position of bore 68 to be visible also when on the scale ring 65 to be placed on the 24-hour scale points upward, this bore 68 goes through. The bores 69, on the contrary, may be blind bores on the opposite side.

Because the head portion 61 of the coupling pin 58 protrudes into one of the bores 68 or 69 when scale ring 65 is placed on, also the respective switching or coupling position of pin 58 in the radial direction is assured. Switching from the long-term to the short-term program or vice versa can therefore also occur only with the scale ring 65 removed, by appropriate radial displacement of the coupling pin 58 in the radial slot 57. Thereafter scale ring 65 is again placed on the program carrier 50 in the described manner, assurance being given by the bores 68 and 69 lying on different radii that always the correct scale is visible, because the bores 69 are provided only on the side of scale ring 65 on which the 24-hour scale is visible.

FIG. 6 illustrates in a simplified manner how instead of the radially displaceable coupling pin 58 a plug-in pin 70 can be used as coupling member, which has a head portion 71 of larger diameter. In this form of realization, the program carrier 50 is provided with two plug-in bores 72,73 at the point where in the example of FIG. 1 to 3, the radial slot 57 is located. Accordingly, the coupling slots 45 and 46 of the two drive rings 35 and 41 are replaced by plug bores 74, 75. Here, too, the diameter of the head portion 71 is matched to the bores 68, 69 of scale ring 65, so that it can be received by them. The switching then occurs by moving the plug pin 70, with the scale ring 65 removed, from the inside out or from the outside in, so that it couples either the drive ring 35 or the drive ring 41 with the program carrier 50. Instead of plug pin 70, there could be provided analogously a threaded pin which can be screwed selectively into one of two threaded bores of the program carrier present in the place of the plug-in bores.

Another realization of the switching device is illustrated in simplified form in FIG. 7. There the switching member consists of a two-armed rocker 78 which is pivotably mounted in a radial slot 79 of the program carrier 50 and engages either a slot type depression 80 in the edge 43 of drive ring 35 for positive coupling or, in the other position, in a corresponding depression 81 in collar 44 of drive ring 41. On the top side of the rocker tappets 82 and 83 are arranged which, depending on the position of rocker 78, protrudes either into the through-bore 68 located in this example on the greater radius or into one of the blind bores 69 of scale ring 65 located on the smaller radius.

Also in this form of realization, the coupling member, which is formed by rocker 78, is captively connected with the program carrier 50, as is the case also in the embodiment of FIG. 1 to 3.

While specific embodiments of the invention have been shown and described in detail to illustrate the application of the principles of the invention, it will be understood that the invention may be embodied otherwise without departing from such principles.

What is claimed is:

1. A timer having an analog time display comprising: a time-controlled clockwork; a circular program carrier synchronously driven by said time-controlled clockwork, said program carrier having slide contacts; a scale ring having one side with designations corresponding to a short-program in which there is one revolution in 24 hours and an opposite side with designations corresponding to a long-term program in which there is one revolution in seven days, the scale ring being selectively applied on said program carrier; a first drive ring disposed concentric with the axis of rotation of said program carrier, said first drive ring being driven at a speed corresponding to the short-term program; a second drive ring disposed concentric with the axis of rotation of said program carrier, said second drive ring being driven at a speed corresponding to the long-term program; and, radially displaceable coupling means connected with said program carrier and adjustable to different radial positions for selectively coupling with one of said first and said second drive rings for movement therewith.

2. A timer according to claim 1 wherein said coupling means includes a downwardly protruding coupling pin, said coupling pin being displaceable in a radial slot provided in said program carrier, said coupling pin being fixable in two different radial positions; each of said first and second drive rings having coupling slots radially open toward each other, for the coupling seeding of said guide pin.

3. A timer according to claim 1, wherein: said coupling means includes one of a plug-in pin and a threaded pin which is selectively insertable into one of two bores, each of said bores being one of bore lying at the same radial distance from a central axis, said one of a plug-in pin or a threaded pin being selectively insertable into one of two bores, each of said two bores being one of a plug-in bore and a threaded bore; said first drive ring and said second drive ring each having a coupling recess to receive said pin so as to couple one of said first and said second drive rings to said program carrier.

4. A timer according to claim 1, wherein: said coupling means includes a rocker member pivotally mounted in a radial slot provided in said program carrier, said rocker being positionable in one of two pivoted positions including a first position in which said rocker engages couplingly in a recess of said first drive ring and a second position in which said rocker engages couplingly in a coupling recess of said second drive ring.

5. A timer according to claim 1, wherein: said second drive ring has a plurality of coupling recesses positioned at equal angular distances, a number of said coupling recesses being equal to the number of times a period of the short-term program is contained in the period of the long-term program.

6. A timer according to claim 5, wherein: said first drive ring has only one coupling recess.

7. A timer according to claim 5, wherein: the coupling recess of said second drive ring is positioned so that the coupling recess of said first drive ring is aligned with a coupling recess of said second drive ring at the same time during the period of the short-term program.

8. A timer according to claim 2, wherein: the coupling pin includes a guiding neck which is of reduced thickness in comparison with a protruding portion of said coupling pin.

9. A timer according to claim 8, wherein: said coupling pin includes a head portion protruding upwardly from the radial slot of the program carrier.

10. A timer according to claim 9, wherein: a head portion of the coupling pin has a greater thickness than said guiding neck which is adapted to be positioned within the width of the radial slot.

11. A timer according to claim 1, wherein: said scale ring bears one of two ring face, one ring face corresponding to the long-term program and the other ring face corresponding to the short-term program, said scale ring being concentricly placed on the program carrier, lockingly and detachably.

12. A timer according to claim 11, wherein the scale ring has at least two openings radially aligned with each other adapted to receive a portion of said coupling means.

13. A timer having an analog time display comprising: a time-controlled clockwork; a circular program carrier synchronously driven by said time-controlled clockwork, said program carrier having slide contacts; a first drive ring disposed concentric with the axis of rotation of said program carrier, said first drive ring being driven at a speed corresponding to a short-term program; a second drive ring disposed concentric with the axis of rotation of said program carrier, said second drive ring being driven at a speed corresponding to a long-term program; and, radially displaceable coupling means connected with said program carrier and adjustable to different radial positions for selectively coupling with one of said first and said second drive rings for movement therewith.

* * * * *